US007374409B2

(12) United States Patent
Kawamura

(10) Patent No.: US 7,374,409 B2
(45) Date of Patent: May 20, 2008

(54) RECIPROCATING PUMP

(75) Inventor: Hitoshi Kawamura, Sanda (JP)

(73) Assignee: Nippon Pillar Packing Co., Ltd., Osaka (JP)

( * ) Notice: Subject to any disclaimer, the term of this patent is extended or adjusted under 35 U.S.C. 154(b) by 718 days.

(21) Appl. No.: 10/834,669

(22) Filed: Apr. 28, 2004

(65) Prior Publication Data

US 2004/0219044 A1 Nov. 4, 2004

(30) Foreign Application Priority Data

May 2, 2003 (JP) ..... P 2003-127168

(51) Int. Cl.
*F04B 43/00* (2006.01)
*F04B 45/02* (2006.01)
*F04B 7/00* (2006.01)
*F04C 21/00* (2006.01)

(52) U.S. Cl. ..... 417/472; 417/443; 417/481

(58) Field of Classification Search ..... 137/512; 417/472, 481, 443

See application file for complete search history.

(56) References Cited

U.S. PATENT DOCUMENTS 1,896,237 A * 2/1933 Huff ..... 137/512
2,367,893 A * 1/1945 Sheen ..... 417/454
4,253,524 A * 3/1981 Erickson ..... 166/325
4,483,665 A * 11/1984 Hauser ..... 417/401

FOREIGN PATENT DOCUMENTS

| | | | |
|---|---|---|---|
| EP | 431753 | A1 | 6/1991 |
| EP | 1096147 | A2 | 5/2001 |
| EP | 1132668 | A2 | 9/2001 |
| EP | 1154157 | A2 | 11/2001 |
| JP | 05269062 | A * | 10/1993 |
| JP | 11324926 | | 11/1999 |
| JP | 2000 213465 | A | 8/2000 |
| WO | 95/23924 | A | 9/1995 |

* cited by examiner

*Primary Examiner*—Devon C. Kramer
*Assistant Examiner*—Patrick Hamo
(74) *Attorney, Agent, or Firm*—Panitch Schwarze Belisario & Nadel LLP

(57) ABSTRACT

A suction passage (1) and a discharge passage (2) for a to-be-transferred fluid are disposed in a pump body (3). A bottomed cylindrical bellows (6) is integrally coupled to the axial rear side of the pump body to form a closed space (7). The suction passage (1) has an upstream portion (1A) having a larger diameter and a predetermined passage cross section area, and downstream portions (1B) which are formed by branching the upstream portion into a bifurcated or Y-shape while reducing the passage cross section area. Two first small check valves (15) of the spring type in each of which the pressure receiving area is reduced in accordance with the reduced passage cross section areas of the smaller-diameter downstream portions (1B) are attached respectively to outlet portions of the smaller-diameter down-stream portions (1B) so as to be arranged in parallel. The outlets of the first check valves (15) are opened in the closed space (7).

7 Claims, 14 Drawing Sheets

RECIPROCATING PUMP

BACKGROUND OF THE INVENTION

1. Field of the Invention

The present invention relates to a reciprocating pump which is useful for quantitative transfer of chemical liquids or ultrapure water to be used in processes such as washing of surfaces of ICs or liquid crystal display devices in a semiconductor producing apparatus.

2. Explanation of Related Art

Conventionally, a double-bellows reciprocating pump is known which is useful for quantitative transfer of chemical liquids or ultrapure water to be used in processes such as washing of surfaces of ICs or liquid crystal display devices in a semiconductor producing apparatus (for example, see Japanese Patent Application Laying-Open No. 11-324926).

As shown in FIG. 14, the reciprocating pump has: a pump body 3 in which a suction passage 1 and a discharge passage 2 for a to-be-transferred fluid are disposed; and a bottomed cylindrical pump casing 4 which is integrally coupled to an axial rear end side of the pump body 3. A front end opening peripheral portion 6A of a bottomed cylindrical bellows 6 is air-tightly (liquid-tightly) fixed by an annular pressing plate 5 which is made of FRP, and which is clamped and fixed between a rear end peripheral portion of the pump body 3 and the front end face of the pump casing 4, thereby forming a closed space 7 defined by the pump body 3 and the bellows 6. A fixing plate 8 made of stainless steel is integrally coupled by plural bolts 8A to the rear side of a rear end closing portion 6B of the bellows 6. A tip end portion of a piston rod 9 which rearward elongates in the axial direction is interposed between the fixing plate 8 and the rear end closing portion 6B of the bellows 6. The stainless steel piston rod 9 is integrally coupled to the bellows 6.

A rear end portion of the piston rod 9 is air-tightly passed through a rear end closing portion 4A of the pump casing 4 so as to be advanceable and retractable in the axial direction, and is exposed in a cylinder 10 which is continuous to the rear side of the rear end closing portion 4A. A piston 11 which is to be axially advanced and retracted in the cylinder 10 is secured to the exposed portion. The cylinder 10 and the piston 11 constitute a reciprocal movement portion 12 for extendingly and contractingly deforming the bellows 6 by axial advancing and retracting movements in which the rear end closing portion 6B of the bellows 6 is advanced to the front dead center in the vicinity of the pump body 3, thereby decreasing the capacity of the closed space 7, and the rear end closing portion 6B of the bellows 6 is retracted to the rear dead center remote from the pump body 3, thereby increasing the capacity of the closed space 7. A proximity sensor sensing plate 13 which radially outward extends through an axial cutaway portion 10A formed in a part of the cylinder 10 is secured to the rear end face of the piston 11. Proximity sensors 14A, 14B are placed on the front and rear sides of the proximity sensor sensing plate 13, respectively.

By contrast, a first check valve 15 of the spring type which communicates with the suction passage 1 and allows only a flow in a suction direction to be conducted, and a second check valve 16 of the spring type which communicates with the discharge passage 2 and allows only a flow in a discharge direction to be conducted are attached in a parallel manner to the pump body 3. The outlet of the first check valve 15 and the inlet of the second check valve 16 are opened in the closed space 7.

The outlet of a to-be-transferred fluid suction pipe 18 which is formed by a fluororesin tube is connected through a pipe joint 17 to the inlet of the suction passage 1, and the inlet of a to-be-transferred fluid discharge pipe 19 which is formed by a fluororesin tube is connected via another pipe joint 17 to the outlet of the discharge passage 2. Each of the pipe joints 17 comprises: a nipple 17A having an external thread portion in one end to be screwed to the inlet of the suction passage 1 and the outlet of the discharge passage 2; an inner ring (not shown); and a cap nut-like pressing ring 17C. A valve V1 is connected in the to-be-transferred fluid suction pipe 18. The inlet of the to-be-transferred fluid suction pipe 18 is connected to a liquid tank 20 which stores a to-be-transferred fluid such as cleaning liquid.

The reciprocal movement portion 12 is reciprocally moved by a reciprocal driving device 21. The reciprocal driving device 21 comprises a compressed air supply source 22 consisting of a compressor, an electromagnetic 5-port 3-position directional control valve 23, and a controller 24. The compressed air supply source 22 and a primary port P of the directional control valve 23 are connected to each other through a compressed air supply pipe 25 in which a valve V2 is disposed. A secondary port A of the directional control valve 23 is connected through an air supply and discharge pipe 26 to an air supply and discharge hole 27 formed in the pump casing 4, and a secondary port B is connected through an air supply and discharge pipe 28 to an air supply and discharge hole 29 formed in the cylinder 10.

The controller 24 receives a proximity detection signal from the proximity sensor 14A or 14B which detects the proximity of the proximity sensor sensing plate 13, and outputs a switch signal to the directional control valve 23 on the basis of the proximity signal. When a push button (not shown) disposed on the controller 24 is manually operated, the directional control valve 23 is switched to a neutral position 23C to stop the operation of the reciprocal driving device 21, thereby stopping the operation of the reciprocating pump, or the valve is switched from the neutral position 23C to a first position 23A or a second position 23B to cause the reciprocal driving device 21 to operate, thereby starting the operation of the diaphragm reciprocating pump. In the figure, 30 denotes a cylinder cover which closes a rear end opening of the cylinder 10.

By contrast, a bottomed cylindrical accumulator casing 34 is integrally coupled to an axial front side of the pump body 3. A rear end opening peripheral portion 36A of a bottomed cylindrical accumulator bellows 36 is air-tightly (liquid-tightly) fixed by an annular pressing plate 35 which is made of FRP, and which is clamped and fixed between a front end peripheral portion of the pump body 3 and the rear end face of the accumulator casing 34, thereby forming a closed space 37 defined by the pump body 3 and the accumulator bellows 36. In this example, a pulsation suppression device 38 is integrally disposed on the front side of a front end closed portion 36B of the accumulator bellows 36. The inlet of the discharge passage 2 is opened in the closed space 37, and the closed space 7 communicates with the closed space 37 through the second check valve 16 and a through hole 39.

In the thus configured diaphragm reciprocating pump, the pump body 3, the pump casing 4, the bellows 6, the first check valve 15, the second check valve 16, the accumulator bellows 36, and like components are molded of a fluorine synthetic resin material such as PTFE or PFA which has excellent corrosion and heat resistance.

Next, the operation of the thus configured diaphragm reciprocating pump will be described. As shown in FIG. 14, when, in a pump stop state where the rear end closing portion 6B of the bellows 6 is at the front dead center DP1 in the vicinity of the pump body 3 to decrease the capacity of the closed space 7 and the directional control valve 23 is held to the neutral position 23C, the directional control valve 23 is switched to the second position 23B by manually operating the push button disposed in the controller 24, the compressed air supplied from the compressed air supply source 22 flows into the cylinder 10 via the route of the compressed air supply pipe 25→the primary port P of the directional control valve 23→the secondary port B→the air supply and discharge pipe 28→the air supply and discharge hole 29. Moreover, the compressed air which is in the pump casing 4, and which urges the rear end closing portion 6B of the bellows 6 toward the front dead center DPI via the fixing plate 8 is discharged to the atmosphere via the route of the air supply and discharge hole 27→the air supply and discharge pipe 26→the secondary port A→a primary discharge port R1. Therefore, the piston 11 is retracted to the end position in the cylinder 10, and, in accordance with the retraction, the rear end closing portion 6B of the bellows 6 is retracted to the rear dead center DP2 remote from the pump body 3, thereby increasing the capacity of the closed space 7.

In accordance with the increase of the capacity of the closed space 7, the negative pressure of the closed space 7 is gradually raised, and hence the to-be-transferred fluid stored in the liquid tank 20 is sucked into the closed space 7 via the route of the to-be-transferred fluid suction pipe 18→the suction passage 1→the first check valve 15. Namely, the suction pressure of the to-be-transferred fluid which is sucked from the to-be-transferred fluid suction pipe 18 into the suction passage 1 overcomes the spring force of a spring 15A of the first check valve 15 to expand the first check valve 15 (specifically, retract a valve element 15B of the first check valve 15), and the fluid is then sucked into the closed space 7.

When the suction stroke in which the piston 11 is retracted to the end position and the rear end closing portion 6B of the bellows 6 is retracted to the rear dead center DP2 is ended, the valve element 15B of the first check valve 15 begins to be closed by the spring force of the spring 15A. At the same time, the proximity sensor sensing plate 13 attached to the piston 11 approaches the proximity sensor 14B to be detected thereby, and the proximity detection signal is supplied to the controller 24. The controller 24 outputs the switch signal to the directional control valve 23 on the basis of the proximity detection signal supplied from the proximity sensor 14B, so that the directional control valve 23 is switched to the first position 23A. As a result, the compressed air supplied from the compressed air supply source 22 flows into the pump casing 4 via the route of the compressed air supply pipe 25→the primary port P of the directional control valve 23→the secondary port A→the air supply and discharge pipe 26→the air supply and discharge hole 27. Moreover, the compressed air in the cylinder 10 is discharged to the atmosphere via the route of the air supply and discharge hole 29→the air supply and discharge pipe 28→the secondary port B→a primary discharge port R2. Therefore, the rear end closing portion 6B of the bellows 6 is advanced to the front dead center DP1 via the fixing plate 8, whereby the capacity of the closed space 7 is decreased and the piston 11 is advanced to the starting position in the cylinder 10.

When the capacity of the closed space 7 is decreased, the to-be-transferred fluid inside the closed space 7 overcomes the spring force of a spring 16A of the second check valve 16 to expand the second check valve 16 (specifically, retract a valve element 16B of the second check valve 16), and is then discharged into the closed space 37 via the through hole 39 to be temporarily stored therein. Thereafter, the fluid is discharged into the to-be-transferred fluid discharge pipe 19 via the discharge passage 2. At this time, extending and contracting deformation of the accumulator bellows 36 is restricted within a constant range by the pulsation suppression device 38, so that the pulsation amplitude can be suppressed to a low level.

At the timing when the discharge stroke in which the piston 11 is advanced to the start position and the rear end closing portion 6B of the bellows 6 is advanced to the front dead center DP1 is ended, the second check valve 16 is closed. At the same time, the proximity sensor sensing plate 13 attached to the piston 11 approaches the proximity sensor 14A to be detected thereby, and the proximity detection signal is supplied to the controller 24. The controller 24 outputs the switch signal to the directional control valve 23 on the basis of the proximity detection signal supplied from the proximity sensor 14A, so that the directional control valve 23 is switched to the second position 23B. Thereafter, the above-mentioned operation is repeated so that quantitative transfer of the to-be-transferred fluid can be conducted in an intermittent manner, until when the directional control valve 23 is switched to the neutral position 23C by manually operating the push button disposed in the controller 24.

In a reciprocating pump of this kind, in the case where the suction stroke is switched to the discharged stroke, the inertia force of the to-be-transferred fluid in the suction passage 1, i.e., the inertia force of the to-be-transferred fluid which, in the suction stroke that is conducted immediately before the switch to the discharged stroke, flows through the suction passage 1 toward the first check valve 15 is applied as a load on the valve element 15B of the single first check valve 15. In the conventional reciprocating pump, the single first check valve 15 having a pressure receiving area which substantially corresponds to the passage cross section area of the suction passage 1 is disposed. More specifically, the pump has a structure where the single first check valve 15 in which the projected area (pressure receiving area) of the valve element 15B facing the suction passage 1 is set to a large value substantially corresponding to the passage cross section area of the suction passage 1 is disposed. Therefore, the inertia force is applied to the valve element 15B as a pressing force which is intensified in accordance with the large increased pressure receiving area. The large pressing force overcomes the spring force of the spring 15A to impede smooth "closing" of the valve element 15B, i.e., a smooth closing operation of the first check valve 15, thereby causing an improper operation such as chattering.

By contrast, even in a structure where the single first check valve 15 having a large pressure receiving area is used as described above, a spring 15A made of a metal may be used, so that the spring force is enhanced. In this case, even when a large pressing force is applied to the valve element 15B by the inertial force of the to-be-transferred fluid, the spring force of the spring 15A can overcome the pressing force to enable the first check valve 15 to conduct a smooth closing operation, and hence it is possible to prevent an improper operation such as chattering from occurring. In the case of a reciprocating pump to be applied to quantitative transfer of chemical liquids or ultrapure water to be used in processes such as washing of surfaces of ICs or liquid crystal display devices in a semiconductor producing apparatus, however, the use of the spring 15A made of a metal is restricted, and hence it is compelled to use the spring 15A made of a fluororesin material such as PTFE or PFA in which a high spring force cannot be expected.

SUMMARY OF THE INVENTION

The invention has been conducted in view of such circumstances. It is an object of the invention to provide a reciprocating pump in which, even in a situation where a first check valve must be provided with a spring made of a resin that is not expected to exert a high spring force, a smooth valve closing operation can be conducted and an improper operation such as chattering can be surely prevented from occurring.

According to the invention, in order to attain the object, the reciprocating pump is configured in the following manner.

The reciprocating pump includes: a pump body (3) comprising a suction passage (1) and a discharge passage (2) for a to-be-transferred fluid; a diaphragm (6) which is air-tightly fixed to the pump body (3) to form a closed space (7); a reciprocal driving device (21) which drives the diaphragm (6) to expand and contract in an axial direction of the pump body (3), thereby increasing and decreasing a capacity of the closed space (7); a plurality of first check valves (15) which are disposed between the suction passage (1) and the closed space (7), and which, when the capacity of the closed space (7) is increased, allow only a suction flow of the to-be-transferred fluid that flows in a suction direction from the suction passage (1) to the closed space (7), each of the first check valves having a pressure receiving area that is smaller than a passage cross section area of the suction passage (1), the first check valves (15) causing the suction passage (1) to communicate with the closed space (7); and a second check valve (16) which is disposed between the discharge passage (2) and the closed space (7), and which, when the capacity of the closed space (7) is decreased, allows only a flow of the to-be-transferred fluid that flows in a discharge direction from the closed space (7) to the discharge passage (2).

The invention has the following effects and advantages.

According to the configuration, each of the first check valves has a small pressure receiving area, and hence the inertia force of the to-be-transferred fluid is applied on the first check valve as a pressing force which is reduced in level in accordance with the small pressure receiving area. As a result, the pressing force acting on each of the first check valves due to the inertia force of the to-be-transferred fluid can be weakened.

In the invention, preferably, the first check valves are arranged in parallel.

In the invention, the first check valves are arranged in series.

In the invention, preferably, the suction passage has an upstream portion having a predetermined passage cross section area, and a plurality of downstream portions which are formed by branching the upstream portion, and each of which has a passage cross section area that is smaller than the predetermined passage cross section area, and the downstream portions communicate with the closed space through the first check valves, respectively.

In the invention, preferably, the first check valves are placed on a side face of the suction passage, and arranged in an axial direction of the suction passage.

In the invention, preferably, the first check valves are unitized.

When the first check valves are compactly arranged as described above, the valves can be easily disposed in a limited space.

In the invention, the diaphragm is a bellows.

DESCRIPTION OF THE PREFERRED EMBODIMENTS

Figure 1:
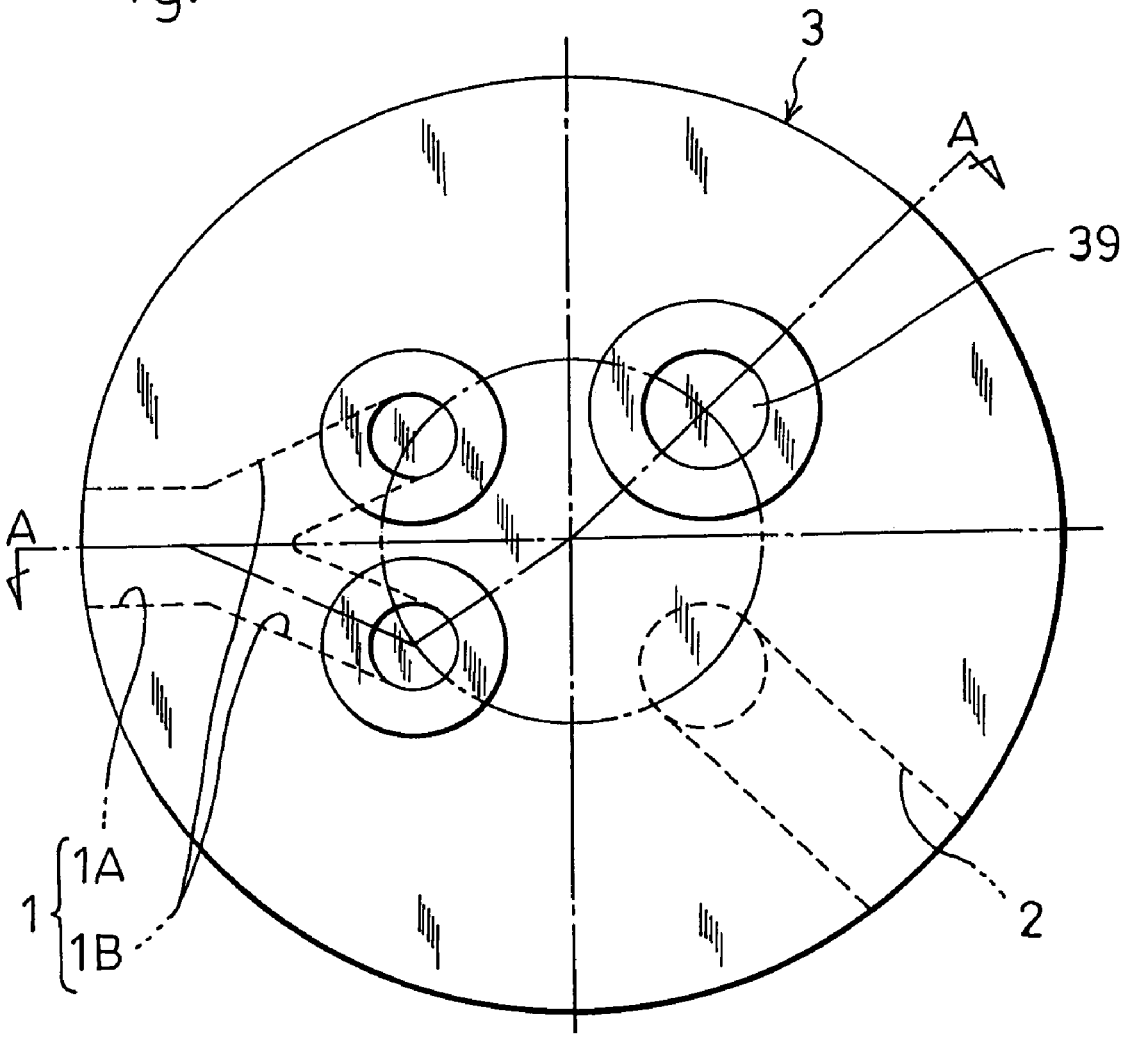
FIG. 1 is a front view showing main portions of an embodiment in which the invention is applied to a double-bellows reciprocating pump.

First, embodiments in which the invention is applied to a double-bellows reciprocating pump will be described with reference to the accompanying drawings. The conventional reciprocating pump which has been described with reference to FIG. 14 can be used as a double-bellows reciprocating pump to which the invention is applied. Therefore, duplicated description of the structure and function of the reciprocating pump will be omitted, and only first check valves which constitute the characteristic configuration of the invention will be described with denoting portions identical with those of the conventional art example by the same reference numerals.

Figure 2:
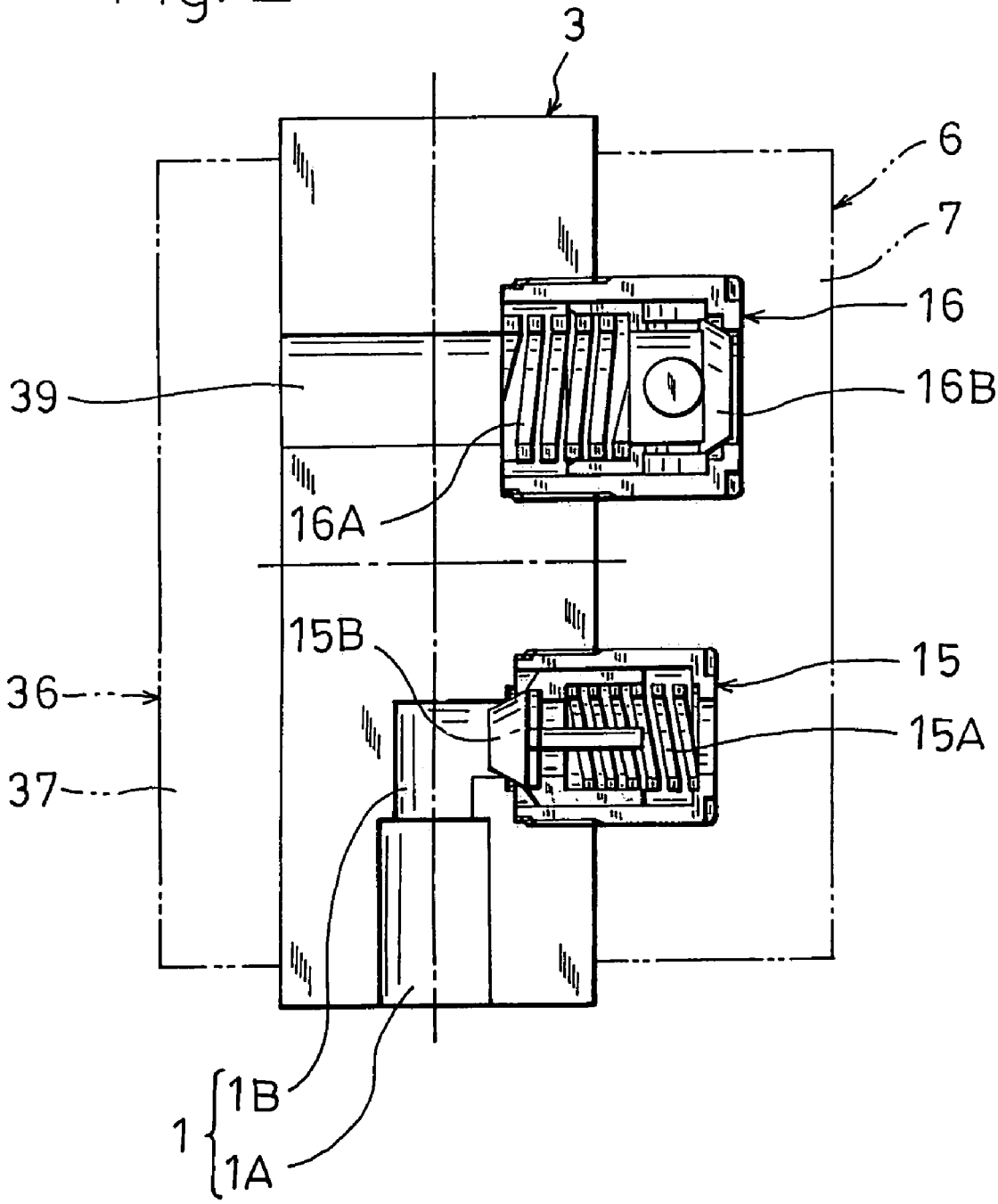
FIG. 2 is a section view taken along the line A-A in FIG. 1.

FIG. 1 is a front view showing an embodiment of the invention., and FIG. 2 is a section view taken along the line A-A in FIG. 1. Referring to the figures, the suction passage 1 and the discharge passage 2 for the to-be-transferred fluid, and the through hole 39 are disposed in the pump body 3. The bottomed cylindrical bellows 6 is integrally coupled to the axial rear side of the pump body 3, and the bottomed cylindrical accumulator bellows 36 is integrally coupled to the axial front side of the pump body 3. The second check valve 16 of the spring type which allows only a flow in the discharge direction is attached to the through hole 39. The inlet of the valve is opened in the closed space 7.

By contrast, the suction passage 1 comprises a larger-diameter upstream portion 1A having a predetermined passage cross section area, and smaller-diameter downstream portions 1B which are formed by branching the larger-diameter upstream portion 1A into a bifurcated or Y-shape so that each of the downstream portions has a passage cross section area that is reduced to about ½. Two first small check valves 15 of the spring type in each of which the pressure receiving area is reduced to about ½ in accordance with the reduced passage cross section areas of the smallerdiameter downstream portions 1B are attached to outlet portions of the smaller-diameter downstream portions 1B so as to be arranged in parallel. The outlets of the first check valves 15 are opened in the closed space 7.

In the configuration, in the case where the stroke of the reciprocating pump is switched from the suction state to the discharged stroke, the inertia force of the to-be-transferred fluid in the suction passage 1 is applied as a load from the smaller-diameter downstream portions 1B which are formed by branching into a bifurcated or Y-shape with reducing the passage cross section area to about ½, on the two first check valves 15 in each of which the pressure receiving area is reduced to about ½ in accordance with the reduced passage cross section areas of the smallerdiameter downstream portions 1B. More specifically, the inertia force is applied on the valve elements 15B in which the projected areas (pressure receiving areas) of the valve elements 15B respectively facing the smaller-diameter down-stream portions 1B are reduced in accordance with the passage cross section areas of the smaller-diameter downstream portions 1B.

As described above, the pressure receiving area of each of the first check valves 15 is reduced, and the inertia force of the to-be-transferred fluid is applied on the first check valve 15 as a pressing force which is reduced in level in accordance with the small pressure receiving area, whereby the pressing force acting on each of the first check valves 15 due to the inertia force of the to-be-transferred fluid, i.e., the pressing force which presses the valve element 15B can be weakened. Even when the spring 15A of each of the first check valves 15 is made of a fluororesin material such as PTFE or PFA in which a high spring force cannot be expected, therefore, the spring force of the spring 15A overcomes the pressing force acting on the valve element 15B due to the inertia force, and the first check valve 15 is smoothly closed, so that an improper operation such as chattering can be surely prevented from occurring. Since the first small check valves 15 are arranged in parallel, the first check valves 15 can be compactly combined with each other, so that the valves can be easily disposed in a space which is limited in design. When the total pressure receiving area of the two first check valves 15 is set to a value which is equal to the passage cross section area of the suction passage 1, i.e., that of the larger-diameter upstream portion 1A, the required flow amount of the to-be-transferred fluid can be ensured.

Figure 3:
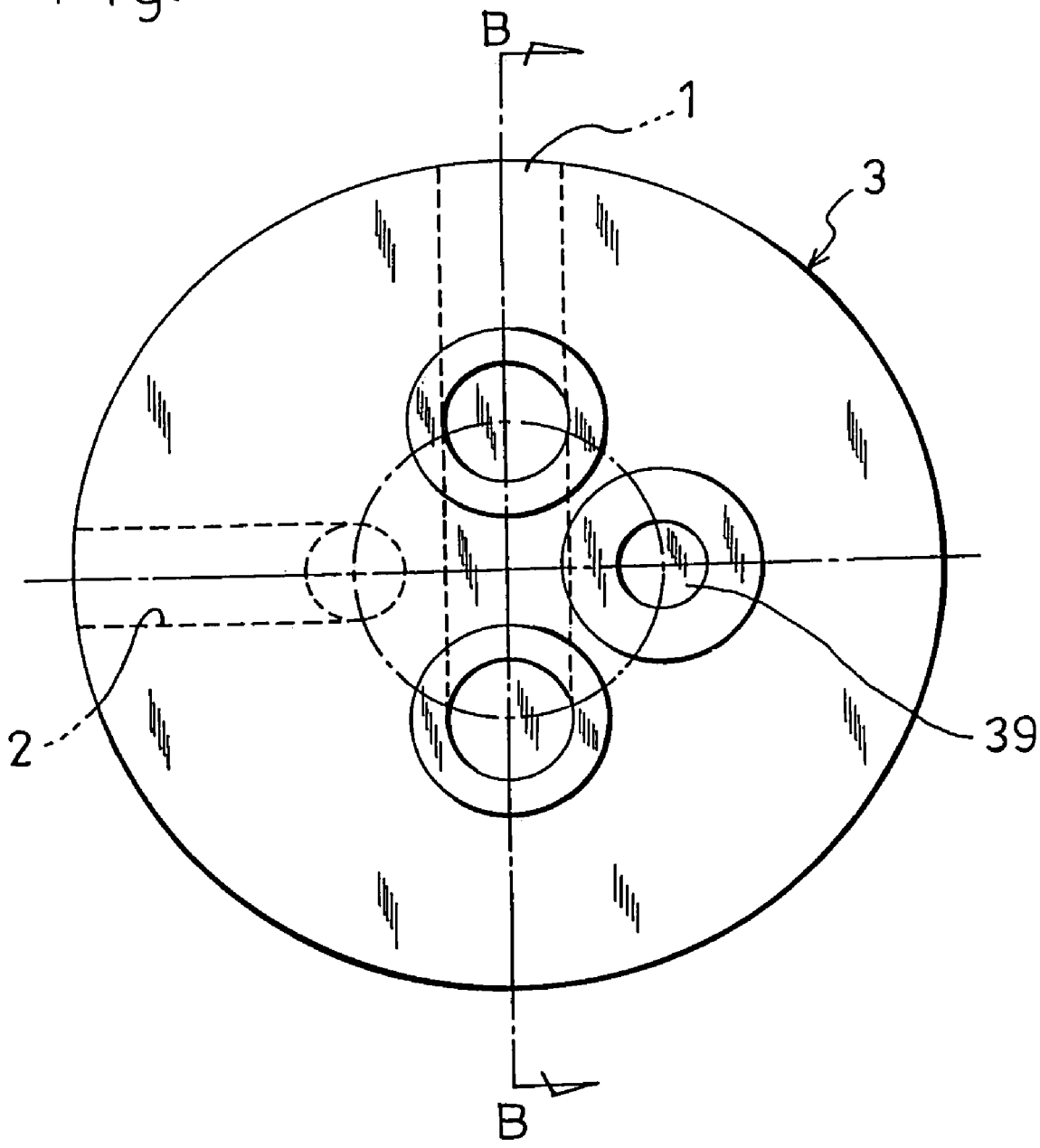
FIG. 3 is a front view showing main portions of a second embodiment in which the invention is applied to a double-bellows reciprocating pump.
Figure 4:
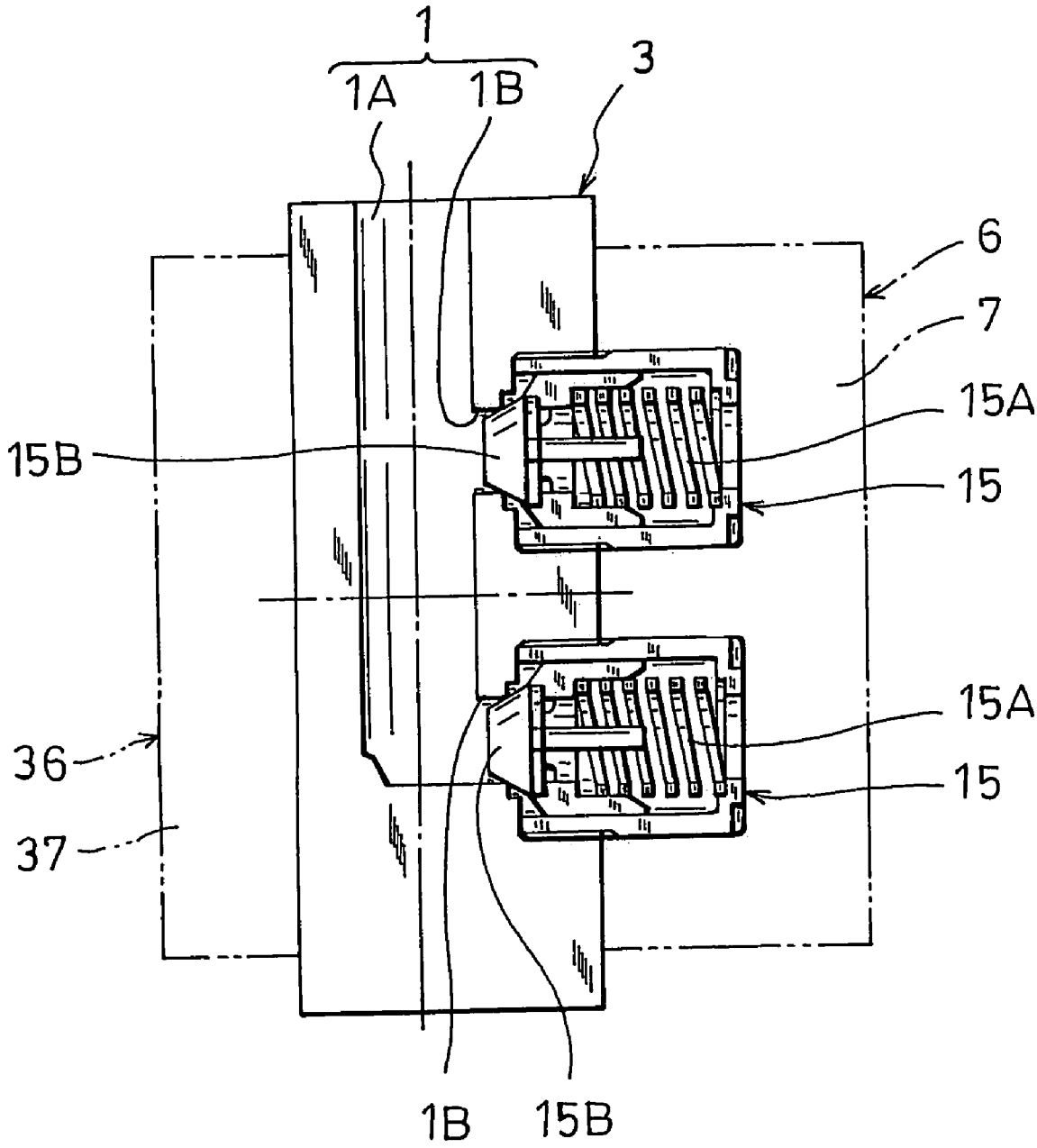
FIG. 4 is a section view taken along the line B-B in FIG. 3.

As shown in FIGS. 3 and 4, plural outlet portions are placed in the side face of the suction passage 1 so as to be arranged in the axial direction of the suction passage 1. First small check valves 15 of the resin-made spring type having a small pressure receiving area which corresponds to the reduced passage cross section areas of the smaller-diameter downstream portions 1B are attached to the outlet portions, respectively. The outlets of the first check valves 15 are opened in the closed space 7. Also when the first check valves 15 are arranged in series in this way, it is possible to attain functions and effects which are similar to those of the first embodiment described with reference to FIGS. 1 and 2.

Figure 5:
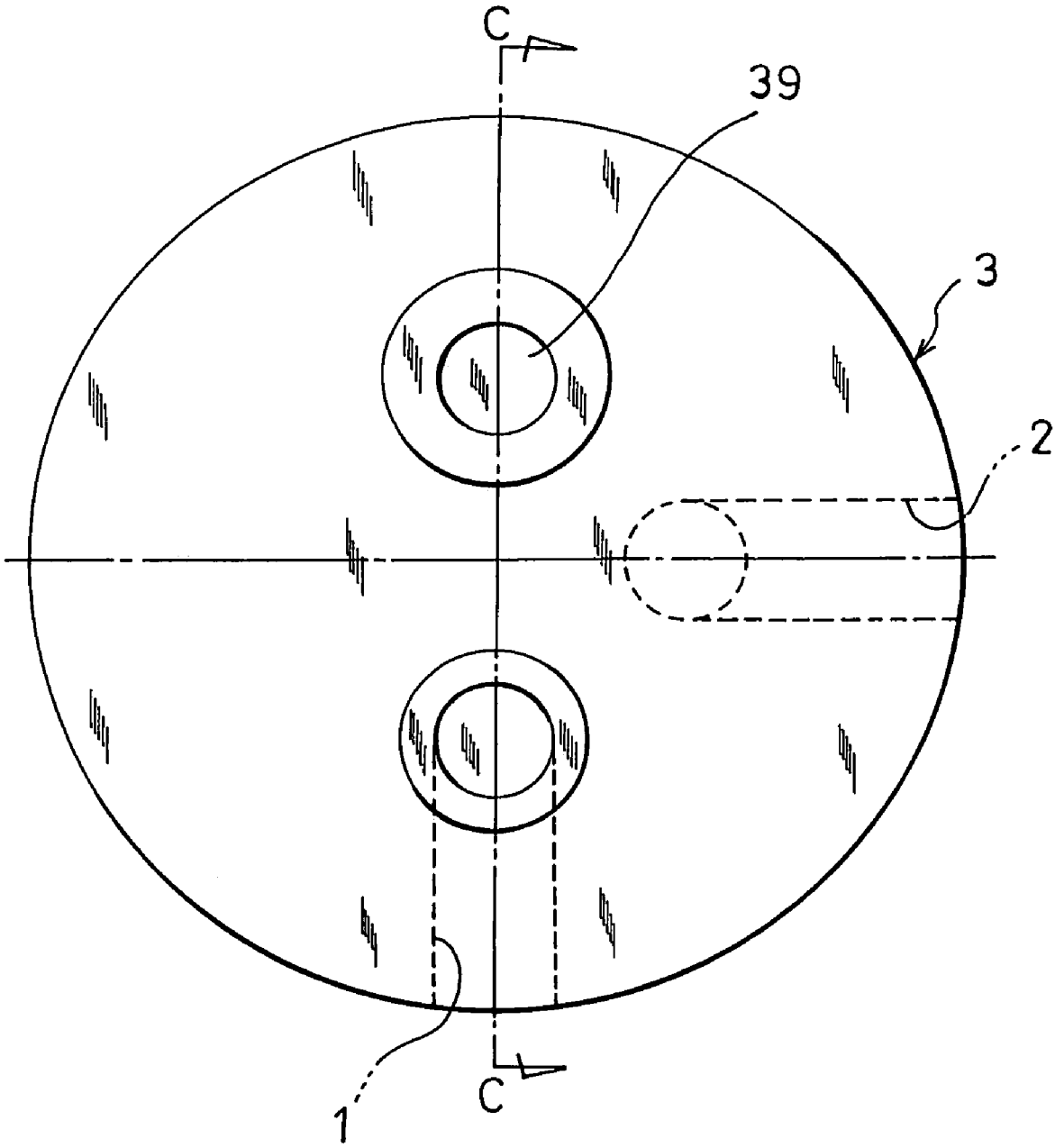
FIG. 5 is a front view showing main portions of a third embodiment in which the invention is applied to a double-bellows reciprocating pump.
Figure 6:
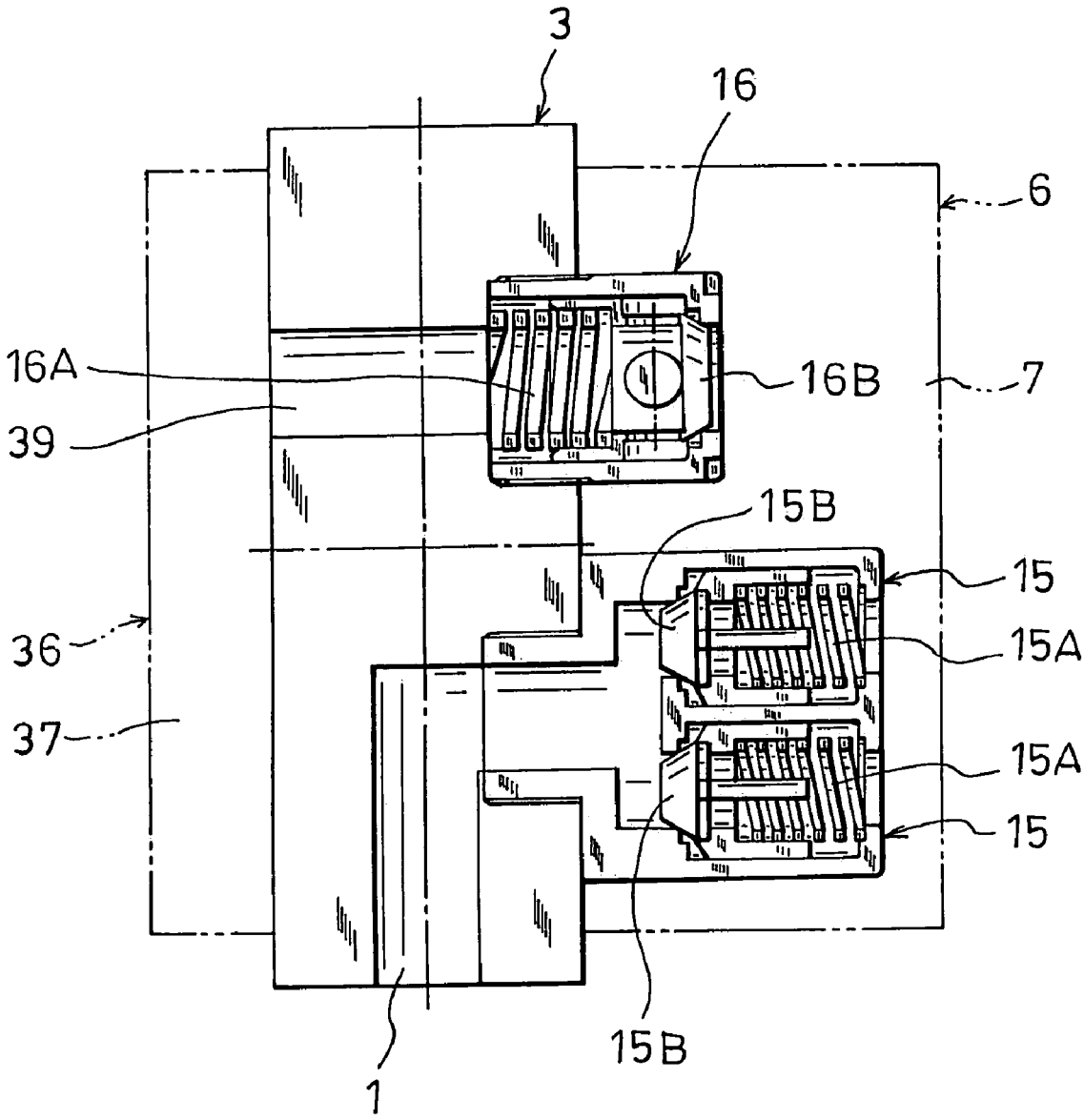
FIG. 6 is a section view taken along the line C-C in FIG. 5.

As shown in FIGS. 5 and 6, alternatively, two first small check valves 15 of the spring type which have a small pressure receiving area, and which are unitized are attached to the outlet of a larger-diameter suction passage 1 having a predetermined passage cross section area. In the alternative also, it is possible to attain functions and effects which are similar to those of the first and second embodiments described with reference to FIGS. 1 to 4. In FIGS. 3 to 6, portions identical with those of FIGS. 1 and 2 are denoted by the same reference numerals, and duplicated description of the structure and function will be omitted.

Figure 7:
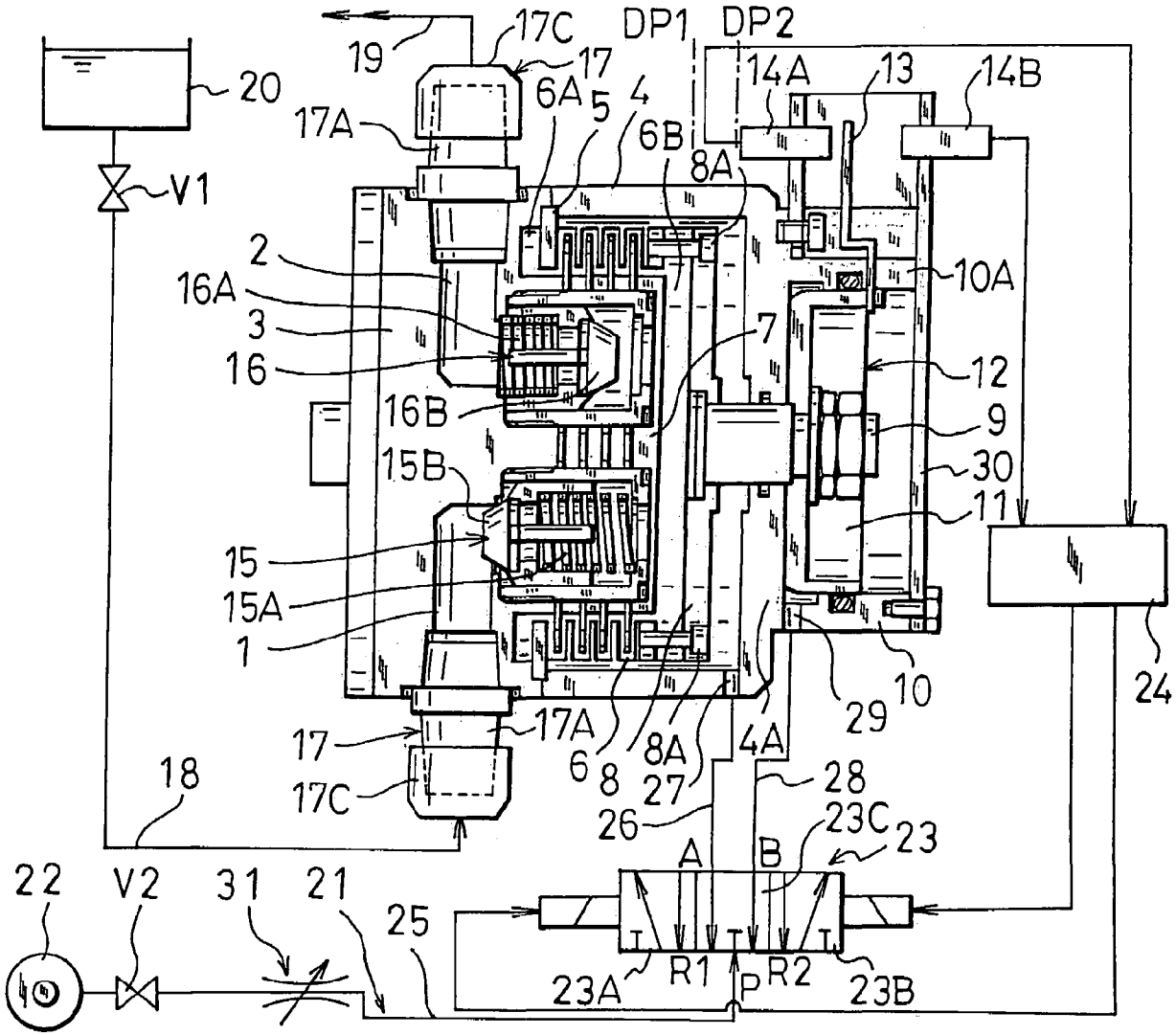
FIG. 7 is a longitudinal section view showing an example of a single-bellows reciprocating pump to which the invention can be applied.
Figure 14:
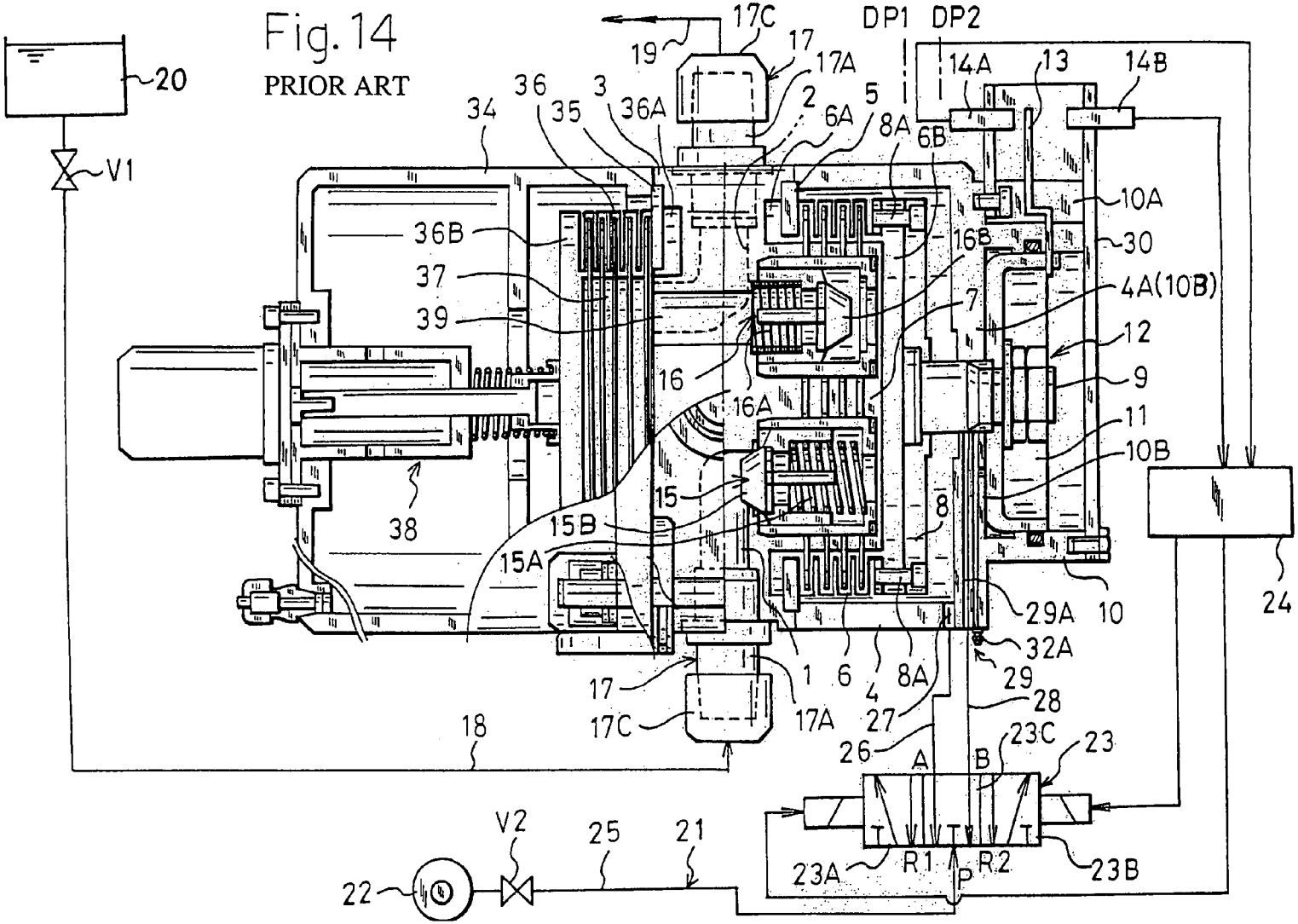
Fig. 14 PRIOR ART
FIG. 14 is a longitudinal section view showing an example of a double-bellows reciprocating pump to which the invention can be applied.

The embodiments described above have the configuration in which the invention is applied to the reciprocating pump shown in FIG. 14, or the double-bellows reciprocating pump comprising: the bottomed cylindrical bellows 6 in which the closed space 7 is formed; and the bottomed cylindrical accumulator bellows 36 in which the closed space 37 is formed. The invention can be applied also to a reciprocating pump shown in FIG. 7 which is conventionally wellknown, or a single-bellows reciprocating pump comprising only a bottomed cylindrical bellows 6 in which a closed space 7 is formed. In the single-bellows reciprocating pump shown in FIG. 7, portions identical with those of the double-bellows reciprocating pump shown in FIG. 14 are denoted by the same reference numerals, and duplicated description of the structure and function will be omitted.

Figure 8:
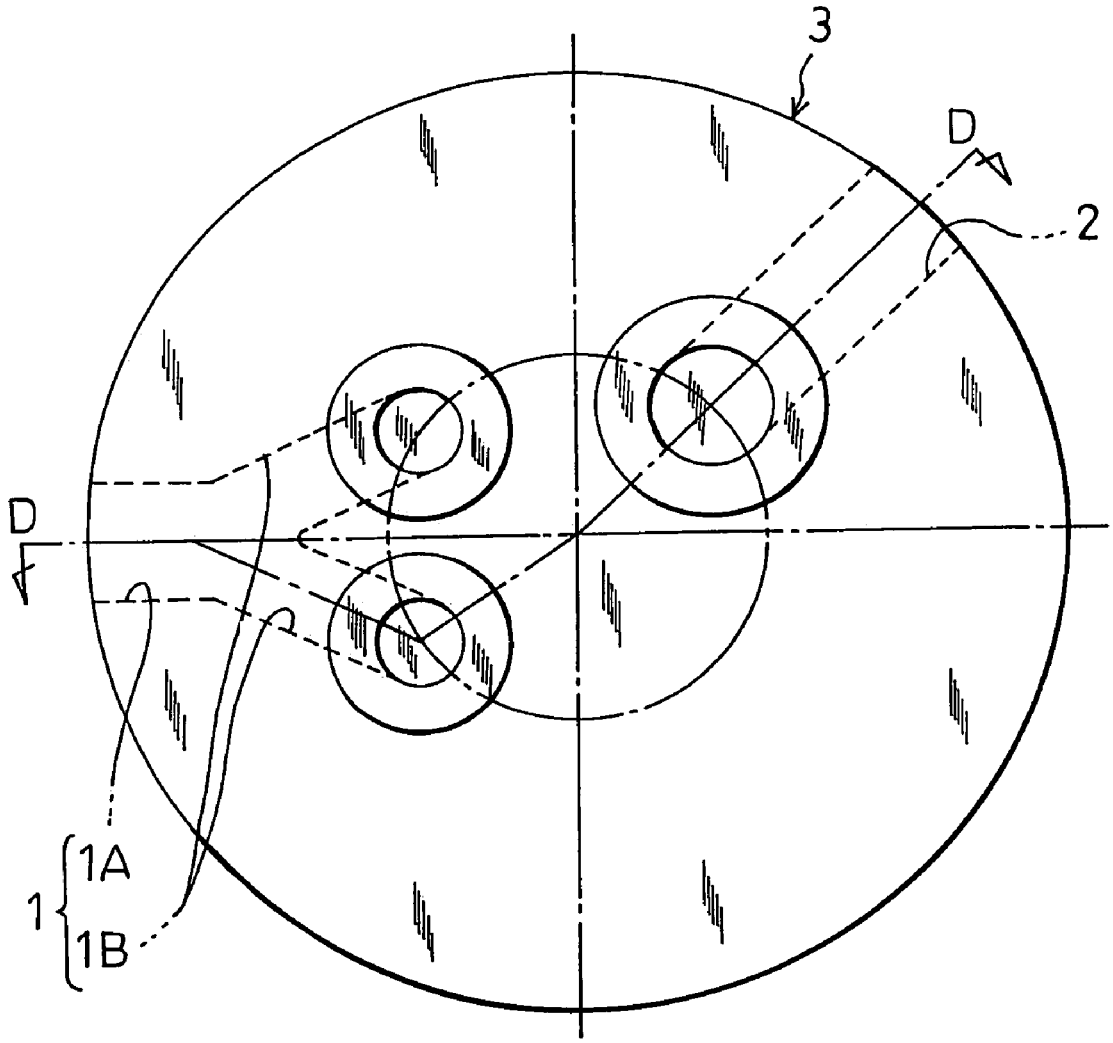
FIG. 8 is a front view showing main portions of an embodiment in which the invention is applied to the reciprocating pump of FIG. 7.
Figure 9:
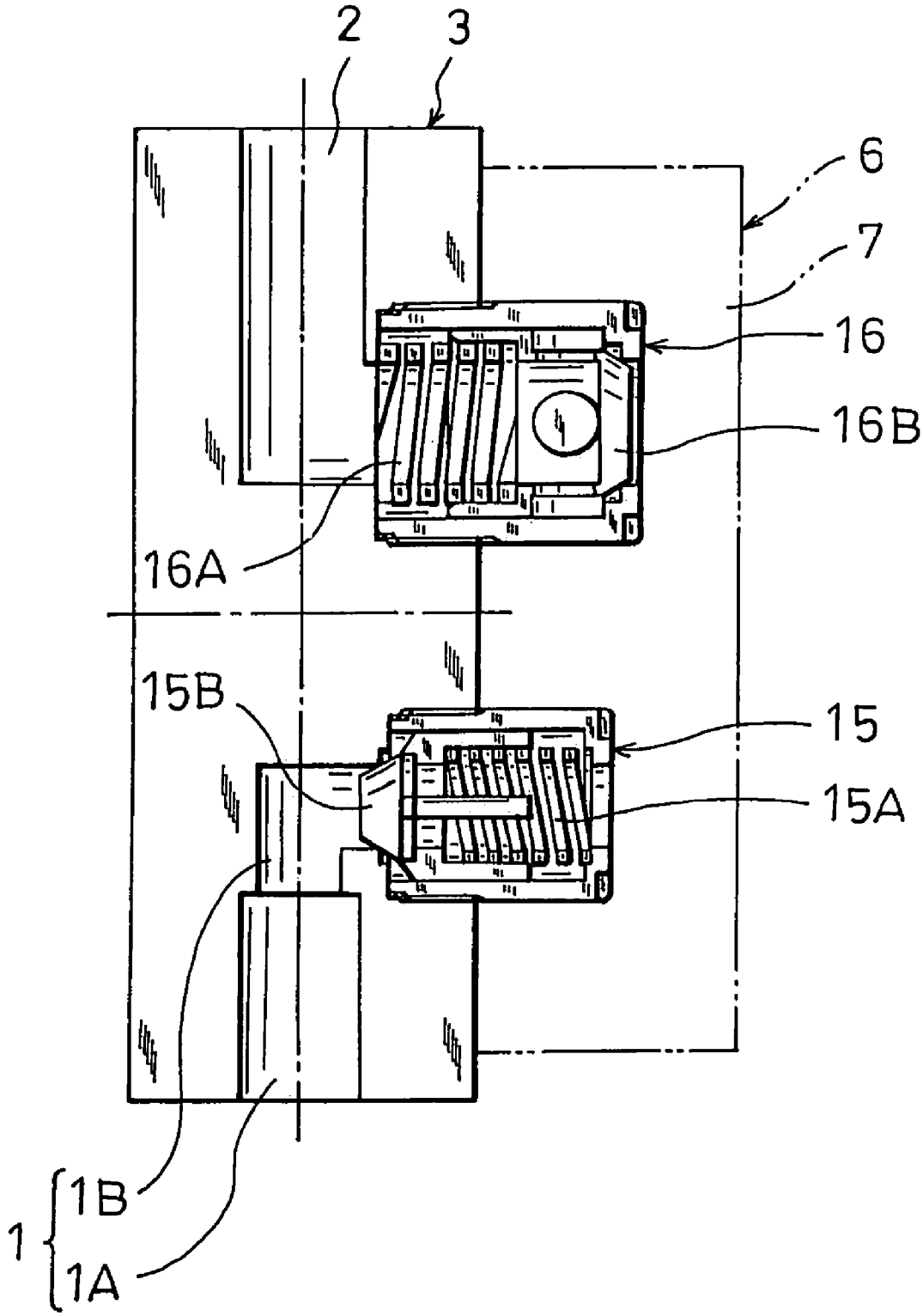
FIG. 9 is a section view taken along the line D-D in FIG. 8.

Referring to FIGS. 8 and 9, the suction passage 1 and the discharge passage 2 for the to-be-transferred fluid are disposed in the pump body 3. The bottomed cylindrical bellows 6 is integrally coupled to the axial rear side of the pump body 3. The second check valve 16 of the spring type which allows only a flow in the discharge direction is attached to the inlet of the discharge passage 2. The inlet of the valve is opened in the closed space 7.

By contrast, the suction passage 1 comprises the larger-diameter upstream portion 1A having a predetermined passage cross section area, and the smaller-diameter downstream portions 1B which are formed by branching the larger-diameter upstream portion 1A into a bifurcated or Y-shape so that each of the downstream portions has a passage cross section area that is reduced to about 1/2. The two first small check valves 15 of the spring type having a small pressure receiving area which corresponds to the reduced passage cross section areas of the smaller-diameter downstream portions 1B are attached to outlet portions of the smaller-diameter downstream portions 1B to be arranged in parallel. The outlets of the first check valves 15 are opened in the closed space 7.

In the case where the stroke of the reciprocating pump is switched from the suction stroke to the discharged stroke, the inertia force of the to-be-transferred fluid in the suction passage 1 is applied as a load from the smaller-diameter downstream portions 1B which are formed by branching into a bifurcated or Y-shape with reducing the passage cross section area to about ½, on the two first check valves 15 in each of which the pressure receiving area is reduced in accordance with the reduced passage cross section areas of the smaller-diameter downstream portions 1B. More specifically, the inertia force is applied on the valve elements 15B in which the projected areas (pressure receiving areas) of the valve elements 15B respectively facing the smaller-diameter downstream portions 1B are reduced in accordance with the passage cross section areas of the smaller-diameter downstream portions 1B.

Therefore, the pressing force acting on each of the valve elements 15B due to the inertia force, i.e., the pressing force on each of the first check valves 15 can be weakened. Even when the spring 15A of each of the first check valves 15 is made of a fluororesin material such as PTFE or PFA in which a high spring force cannot be expected, therefore, the spring force of the spring 15A overcomes the pressing force acting on the valve element 15B due to the inertia force, and the first check valve 15 is smoothly closed, so that an improper operation such as chattering can be surely prevented from occurring. Since the first small check valves 15 are arranged in parallel, the first check valves 15 can be compactly combined with each other, so that the valves can be easily disposed in a space which is limited in design.

Figure 10:
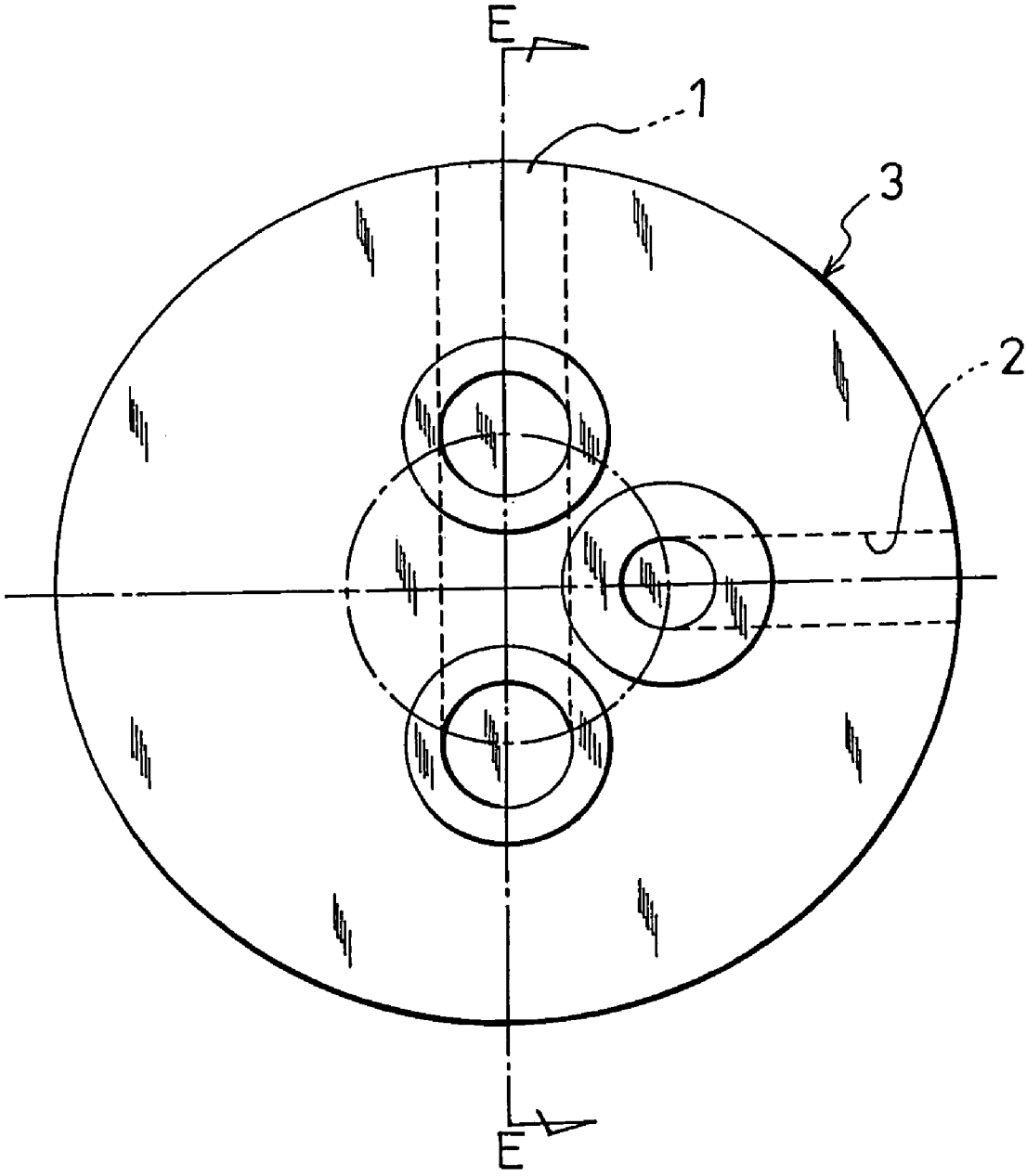
FIG. 10 is a front view showing main portions of a second embodiment in which the invention is applied to the reciprocating pump of FIG. 7.
Figure 11:
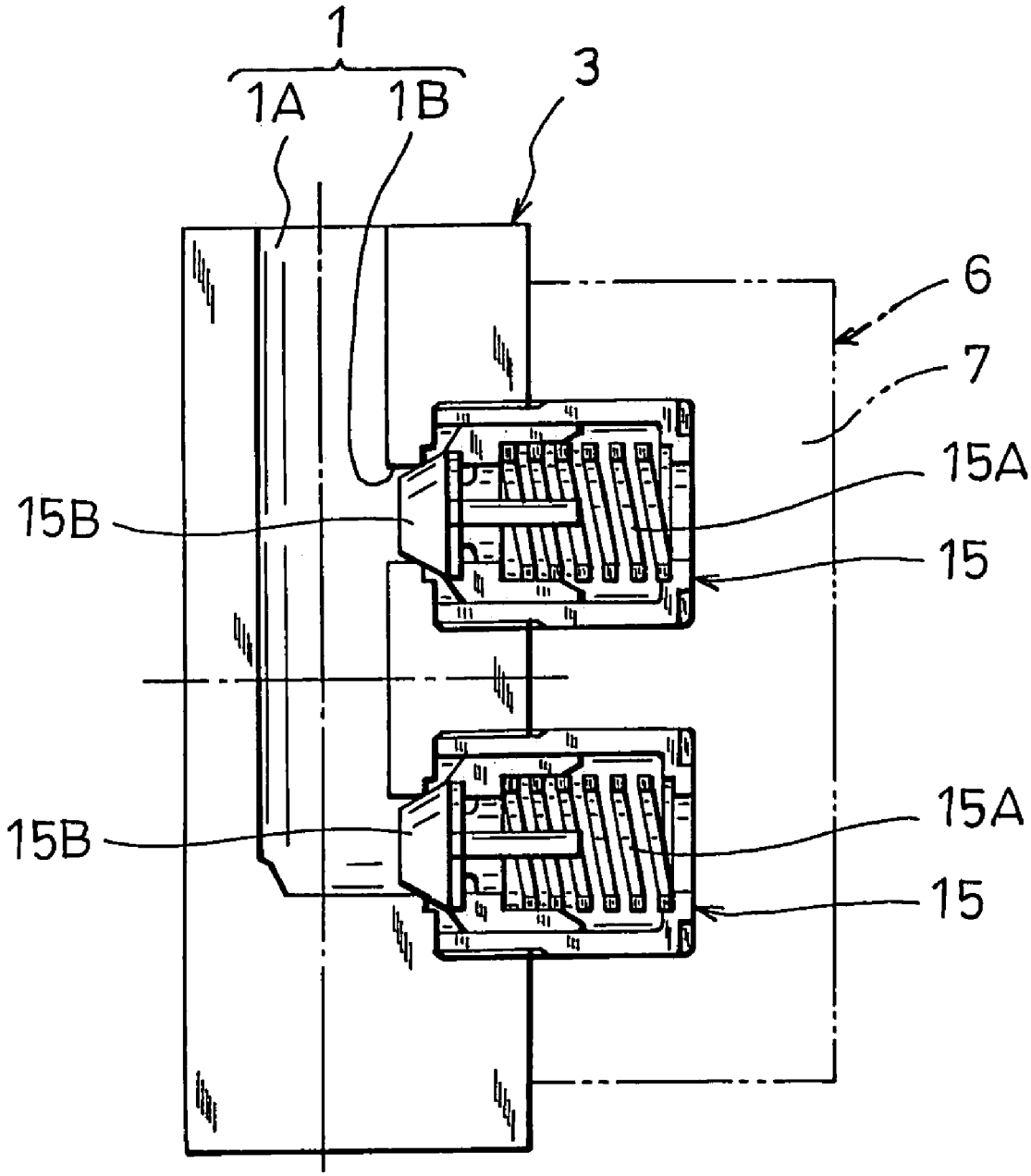
FIG. 11 is a section view taken along the line E-E in FIG. 10.
Figure 12:
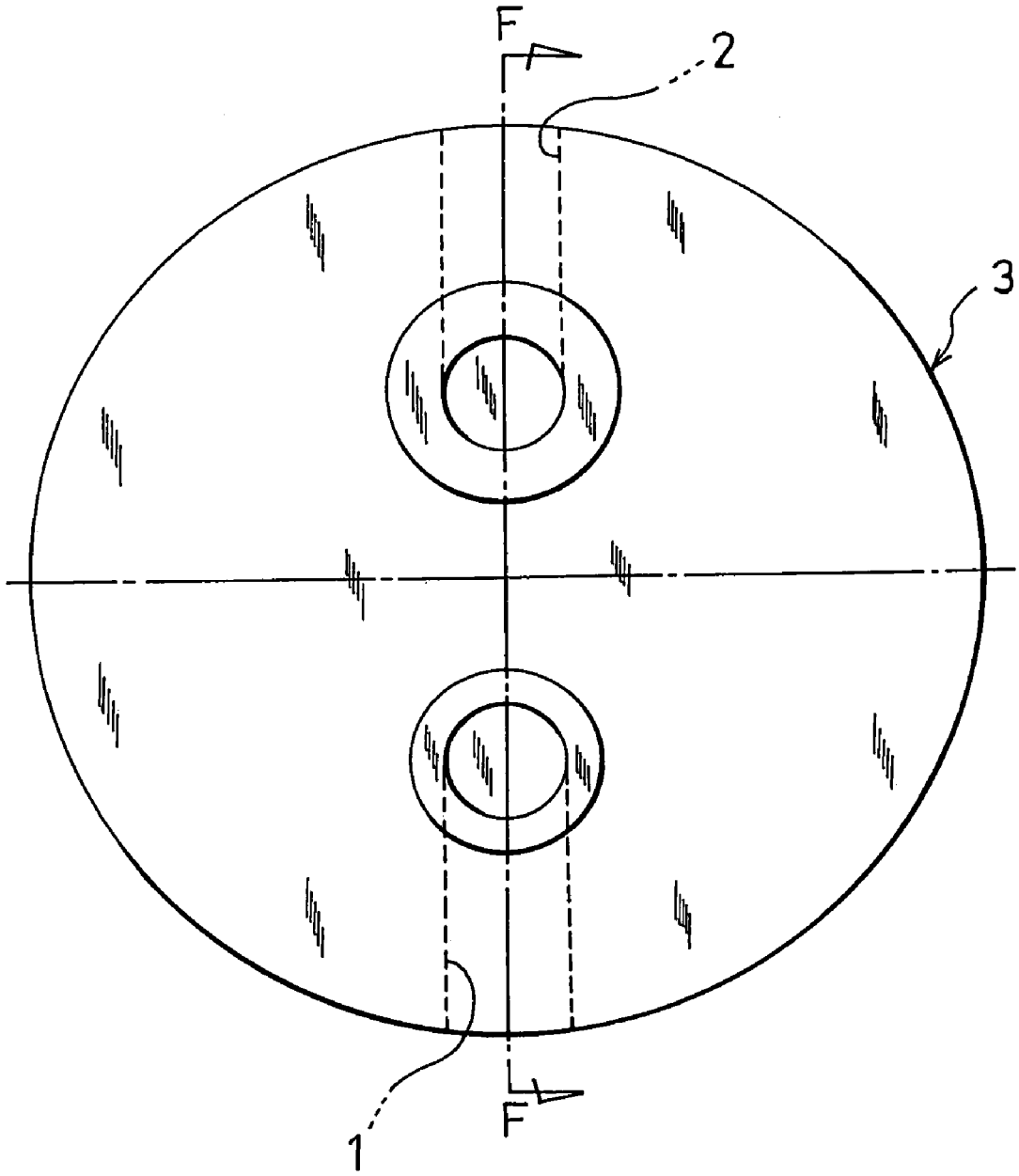
FIG. 12 is a front view showing main portions of a third embodiment in which the invention is applied to the reciprocating pump of FIG. 7.
Figure 13:
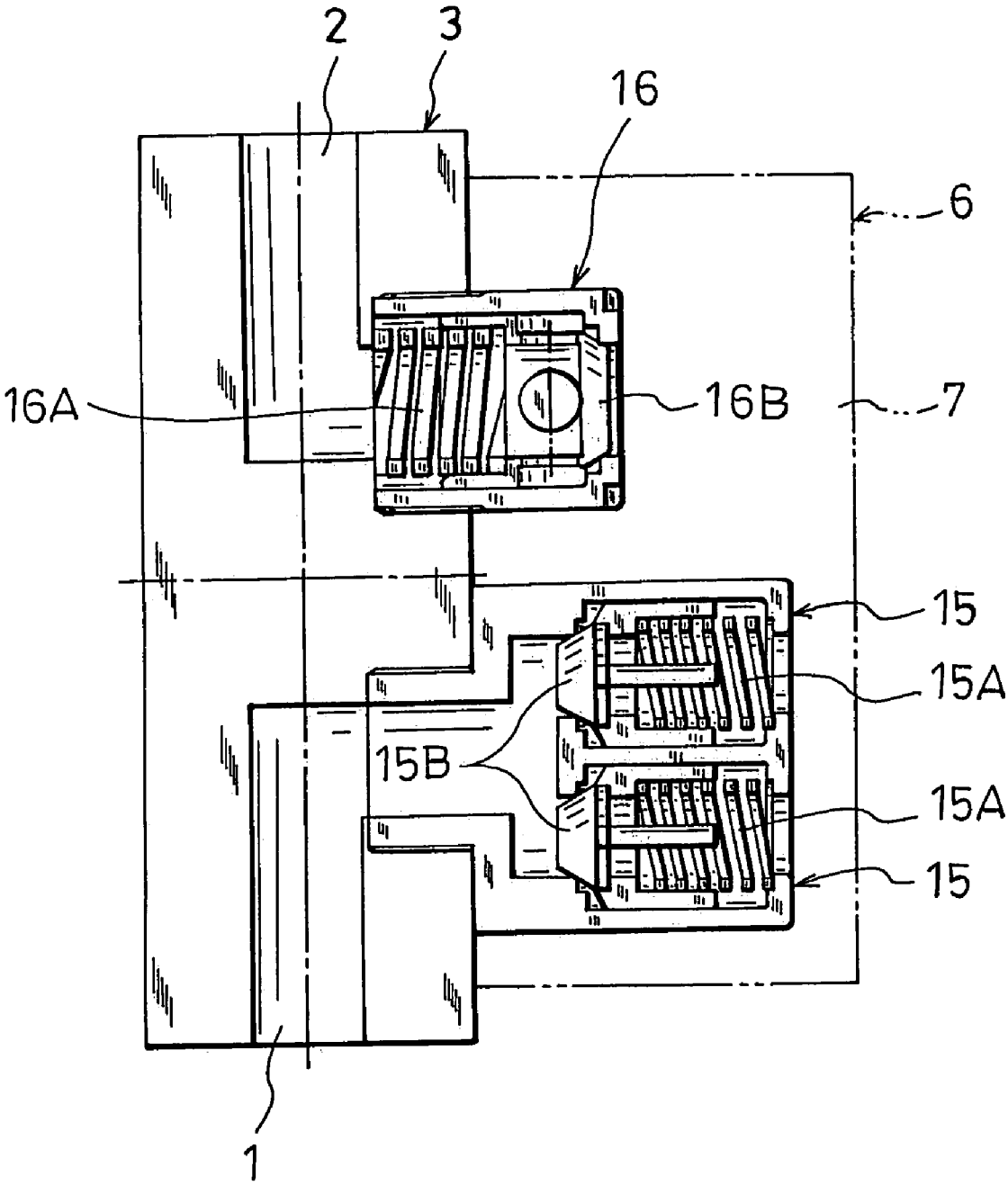
FIG. 13 is a section view taken along the line F-F in FIG. 12.

Also in the case where, as shown in FIGS. 10 and 11, first small check valves 15 of the spring type having a small pressure receiving area which corresponds to the reduced passage cross section areas of the smaller-diameter downstream portions 1B are attached in series, it is possible to attain functions and effects which are similar to those of the embodiment described with reference to FIGS. 8 and 9. As shown in FIGS. 12 and 13, alternatively, two first small check valves 15 of the spring type which have a small pressure receiving area, and which are unitized are attached to the outlet of a larger-diameter suction passage 1 having a predetermined passage cross section area. In the alternative also, it is possible to attain functions and effects which are similar to those of the embodiments described with reference to FIGS. 8 to 11. In FIGS. 10 to 13, portions identical with those of FIGS. 8 and 9 are denoted by the same reference numerals, and duplicated description of the structure and function will be omitted.

The embodiments described above have the configuration in which the two first check valves 15 having a reduced pressure receiving area are used. Alternatively, three or more first check valves 15 having a reduced pressure receiving area may be used. In the case where three or more first check valves 15 having a reduced pressure receiving area are used, however, it is required to set the total pressure receiving area of the three or more first check valves 15 to a value which is equal to or slightly larger than the passage cross section area of the suction passage 1.

In the embodiments described above, the first check valves 15 and the second check valve 16 are disposed in a state where the valves protrude from the pump body 3 toward the closed space 7. Alternatively, a structure may be employed in which the first check valves 15 and the second check valve 16 are embedded into the pump body 3 so as not to protrude toward the closed space 7. In the case of the reciprocating pump in which the bottomed cylindrical accumulator bellows 36 is disposed, a structure may be employed in which the first check valves 15 and the second check valve 16 protrude from the pump body 3 toward the closed space 37.

What is claimed is:

1. A reciprocating pump including:

a pump body comprising a suction passage and a discharge passage for a to-be-transferred fluid;

a diaphragm which is air-tightly fixed to said pump body to form a closed space;

a reciprocal driving device which drives said diaphragm to expand and contract in an axial direction of said pump body, thereby increasing and decreasing a capacity of said closed space;

a plurality of first spring-type check valves having a spring comprised of a fluororesin material which are disposed between said suction passage and said closed space, and which, when the capacity of said closed space is increased, allow only a suction flow of the to-be-transferred fluid that flows in a suction direction from said suction passage to said closed space, each of said first check valves having a pressure receiving area that is smaller than a passage cross section area of said suction passage, said first check valves causing said suction passage to communicate with said closed space; and a second check valve comprised of a fluororesin material which is disposed between said discharge passage and said closed space, and which, when the capacity of said closed space is decreased, allows only a flow of the to-be-transferred fluid that flows in a discharge direction from said closed space to said discharge passage, wherein said suction passage communicates with said closed space via said first check valves having a pressure receiving area that is smaller than a passage cross section area of said suction passage, and the total pressure receiving area of said first check valves is equal to the passage cross section area of said suction passage.

2. The reciprocating pump according to claim 1, wherein said first check valves are arranged in parallel.

3. The reciprocating pump according to claim 1, wherein said first check valves are arranged in series.

4. The reciprocating pump according to claim 1, wherein said suction passage has an upstream portion having a predetermined passage cross section area, and a plurality of downstream portions which are formed by branching said upstream portion, and each of which has a passage cross section area that is smaller than the predetermined passage cross section area, and said downstream portions communicate with said closed space through said first check valves, respectively.

5. The reciprocating pump according to claim 1, wherein said first check valves are placed on a side face of said suction passage, and arranged in an axial direction of said suction passage.

6. The reciprocating pump according to claim 1, wherein said first check valves are unitized.

7. The reciprocating pump according to claim 1, wherein said diaphragm is a bellows.

* * * * *